US007328789B2

(12) United States Patent
Bohanan, Jr. et al.

(10) Patent No.: US 7,328,789 B2
(45) Date of Patent: Feb. 12, 2008

(54) ODOR-ELIMINATING CAMOUFLAGED RECLOSABLE STORAGE BAG

(75) Inventors: James N. Bohanan, Jr., Luling, TX (US); Jesus (Jesse) Leal, Seguin, TX (US); John R. Stevens, Jr., New Braunfels, TX (US); Edward A. Berich, New Braunfels, TX (US)

(73) Assignee: Illinois Tool Works Inc., Glenview, IL (US)

( * ) Notice: Subject to any disclaimer, the term of this patent is extended or adjusted under 35 U.S.C. 154(b) by 347 days.

(21) Appl. No.: 10/763,001

(22) Filed: Jan. 22, 2004

(65) Prior Publication Data

US 2005/0161347 A1 Jul. 28, 2005

(51) Int. Cl.
*B65D 81/24* (2006.01)

(52) U.S. Cl. ..... 206/210; 206/459.5; 206/484.2; 206/524.6; 383/109

(58) Field of Classification Search ..... 206/205, 206/210, 484, 484.2, 524.2, 524.6, 459.5; 2/94; 383/105, 109
See application file for complete search history.

(56) References Cited

U.S. PATENT DOCUMENTS 4,124,549 A 11/1978 Hashiudo et al.
4,861,632 A * 8/1989 Caggiano ..... 383/109
4,987,997 A 1/1991 Raszewski et al.
5,549,938 A 8/1996 Nesbitt ..... 428/17
6,073,772 A 6/2000 Forbes et al. ..... 206/527
6,134,718 A 10/2000 Sesselmann ..... 2/243.1
6,321,907 B1 11/2001 Honstrater
6,505,740 B1 * 1/2003 Marlin et al. ..... 206/524.2
6,531,197 B2 * 3/2003 Neteler ..... 206/484
6,625,816 B1 9/2003 Cooke ..... 2/161.5
6,735,781 B1 * 5/2004 Fulmer ..... 2/94
6,803,090 B2 * 10/2004 Castiglione et al. ..... 428/172
2003/0236159 A1 * 12/2003 Worthy, Jr. ..... 383/106

OTHER PUBLICATIONS

Scent-Lok Brochure (7 pages), downloaded from www.scent-lok.com on Jan. 17, 2004.

* cited by examiner

*Primary Examiner*—Luan K Bui
(74) *Attorney, Agent, or Firm*—Ostrager Chong Flaherty & Broitman P.C.

(57) ABSTRACT

A bag, pack or sack for storing clothing and gear of outdoorsmen, such as hunters and military personnel. The bag, pack or sack may have one or both of two features: means for preventing odors from entering or leaving the interior volume of the bag, pack or sack; and a camouflage pattern visible from a vantage on the exterior of the bag.

16 Claims, 4 Drawing Sheets

ODOR-ELIMINATING CAMOUFLAGED RECLOSABLE STORAGE BAG

BACKGROUND OF THE INVENTION

The present invention is related bags, sacks and packs for storing clothing, gear or other types of articles and also preventing odors from either entering or escaping from the bag, sack or pack. The present invention also relates to camouflaged bags, sacks and packs for use by soldiers and hunters.

In situations where a person in the outdoors wishes to approach wild game, it is desirable that steps be taken to ensure that no odors or scents emanating from that person or that person's clothing and gear can be detected by the keen sense of smell of that wild animal. One solution to this problem is to provide articles of clothing that absorb odors emanating from covered or surrounded body portions. U.S. Pat. No. 6,134,718 discloses that such clothing articles (or a duffle bag or knapsack) may comprise inner and outer layers with "odor absorbing means" being enclosed between the inner and outer layers. The "odor absorbing means" may include "an odor absorbing agent" selected from the group consisting of activated charcoal, chlorophyll, baking soda, activated alumina, soda lime, zeolite, calcium oxide, potassium permanganate or a similar substance. In one example, the "odor absorbing means" takes the form of fibers treated with or having incorporated therein activated carbon or charcoal.

Activated charcoal is charcoal that has been treated with oxygen to open up millions of tiny pores between the carbon atoms and is widely used to "adsorb" odorous substances from gases or liquids. When a material "adsorbs" a molecule, the molecule is attached by chemical attraction. The highly porous activated charcoal provides countless bonding sites on its surface, where molecules attach and are trapped. As used herein, the term "adsorption" means the surface retention of solid, liquid or gas molecules, atoms or ions by a solid or liquid, as opposed to "absorption", which means the penetration of substances into the bulk of the solid or liquid. As used herein, the term "odor-eliminating" means that at least some molecules of an odorous substance are adsorbed or absorbed by the material in question, not that all odor is eliminated.

In addition, special care is taken to remove odors normally associated with humans and other sources of odors not typically found in nature. For example, scent-free detergents are used to wash the clothing. In some cases, a natural scent that emits a desirable (non-human) odor is added to the clothing in order to cover up any remaining human and unnatural odors.

While these approaches have been used in the past to assist outdoorsman in odor control, steps must be taken to maintain the scent-free or scented state of the clothing during transport to the outdoor site. For this purpose special bags, packs and sacks have been designed which have means for blocking odors emanating from outside the bag from contaminating the scent-free or scented clothing inside the bag. More specifically, it is known to provide a bag, sack or pack comprising a layer of material designed to prevent odorous substances from entering the bag, sack or pack and being adsorbed by the clothing therein.

Conversely, in the case of sports accessory bags, it is desired that odors emanating from used athletic uniforms and footwear contained in the bag be prevented from escaping. Thus a properly constructed bag may serve either purpose, by blocking odors from entering or leaving the space enclosed by the bag.

There is a need for improvements in odor-eliminating storage bags. In the case of bags, sacks and packs used by outdoorsmen, such as hunters and soldiers, it is also desirable to provide camouflage that will blend in with a particular outdoor environment.

BRIEF DESCRIPTION OF THE INVENTION

The present invention is directed to bags, packs and sacks for storing clothing and gear of outdoorsmen, such as hunters and military personnel. These bags, packs and sacks may have one or both of two features: means for preventing odors from entering or leaving the interior volume of the bag, pack or sack; and a camouflage pattern visible from a vantage on the exterior of the bag.

One aspect of the invention is a bag comprising a receptacle having a mouth at an upper end, and a plastic zipper attached to the mouth, wherein the zipper comprises first and second zipper strips that extend across the mouth, the first zipper strip comprising a first closure profile and the second zipper strip comprising a second closure profile, the first and second closure profiles being mutually interlockable, the mouth being closed when the first and second closure profiles are interlocked and being open when the first and second closure profiles are disengaged, and wherein the receptacle is made of laminated material, the laminated material comprising first and second layers laminated to each other, the first layer comprising an odor-eliminating agent.

Another aspect of the invention is a bag comprising a receptacle having a mouth at an upper end, and a plastic zipper attached to the mouth, wherein the zipper comprises first and second zipper strips that extend across the mouth, the first zipper strip comprising a first closure profile and the second zipper strip comprising a second closure profile, the first and second closure profiles being mutually interlockable, the mouth being closed when the first and second closure profiles are interlocked and being open when the first and second closure profiles are disengaged, and wherein the receptacle is made of laminated material, the laminated material comprising first and second layers laminated to each other, opposing surfaces of the first and second layers forming an interface, at least one of the opposing surfaces of the first and second layers having a camouflage pattern printed thereon.

A further aspect of the invention is a method of manufacture comprising the following steps: (a) printing a camouflage pattern on a surface of a first web of film; (b) laminating the first web of film to a second web of film to form a laminated web having first and second mutually parallel edges, the second web of film being optically transparent and the printed surface of the first web of film being trapped between the first and second webs; (c) folding the laminated web along a fold line with the second web disposed on the outside of the fold, the fold line being generally parallel to the first and second edges; (d) joining a first zipper strip to a first portion of the first web of the laminated web along a first zone of joinder extending generally parallel to the first and second edges; (e) joining a second zipper strip to a second portion of the first web of the laminated web along a second zone of joinder extending generally parallel to the first and second edges; (f) joining a first transverse portion of the laminated web to a second transverse portion of the laminated web to form a first cross seal generally orthogonal to the first and second edges; and (g) joining a third transverse portion of the laminated web to a fourth transverse portion of the laminated web to form a second cross seal generally parallel to the first cross seal and separated therefrom by a predetermined distance, wherein the first and second cross seals extend from the fold to at least the first and second zipper strips.

Yet another aspect of the invention is a method of manufacture comprising the following steps: (a) blending resin containing odor-eliminating agent with resin for making bag making film; (b) extruding a first web of film using the blended resins; (c) laminating the first web of film to a second web of film to form a laminated web having first and second mutually parallel edges; (d) folding the laminated web along a fold line that lies generally parallel to the first and second edges; (e) joining a first zipper strip to a first portion of the first web of the laminated web along a first zone of joinder extending generally parallel to the first and second edges; (f) joining a second zipper strip to a second portion of the first web of the laminated web along a second zone of joinder extending generally parallel to the first and second edges; (g) joining a first transverse portion of the laminated web to a second transverse portion of the laminated web to form a first cross seal generally orthogonal to the first and second edges; and (h) joining a third transverse portion of the laminated web to a fourth transverse portion of the laminated web to form a second cross seal generally parallel to the first cross seal and separated therefrom by a predetermined distance, wherein the first and second cross seals extend from the fold to at least the first and second zipper strips.

A further aspect of the invention is a bag comprising a receptacle having a mouth at an upper end, and a plastic zipper attached to the mouth, wherein the zipper comprises first and second zipper strips that extend across the mouth, the first zipper strip comprising a first closure profile and the second zipper strip comprising a second closure profile, the first and second closure profiles being mutually interlockable, the mouth being closed when the first and second closure profiles are interlocked and being open when the first and second closure profiles are disengaged, and wherein the receptacle is made of laminated material, the laminated material comprising first and second layers laminated to each other, the first layer comprising a thermoplastic material and a corrosion-inhibiting agent.

Other aspects of the invention are disclosed and claimed below.

BRIEF DESCRIPTION OF THE DRAWINGS

Reference will now be made to the drawings, in which similar elements in different drawings bear the same reference numerals.

DETAILED DESCRIPTION OF THE INVENTION

Figure 1:
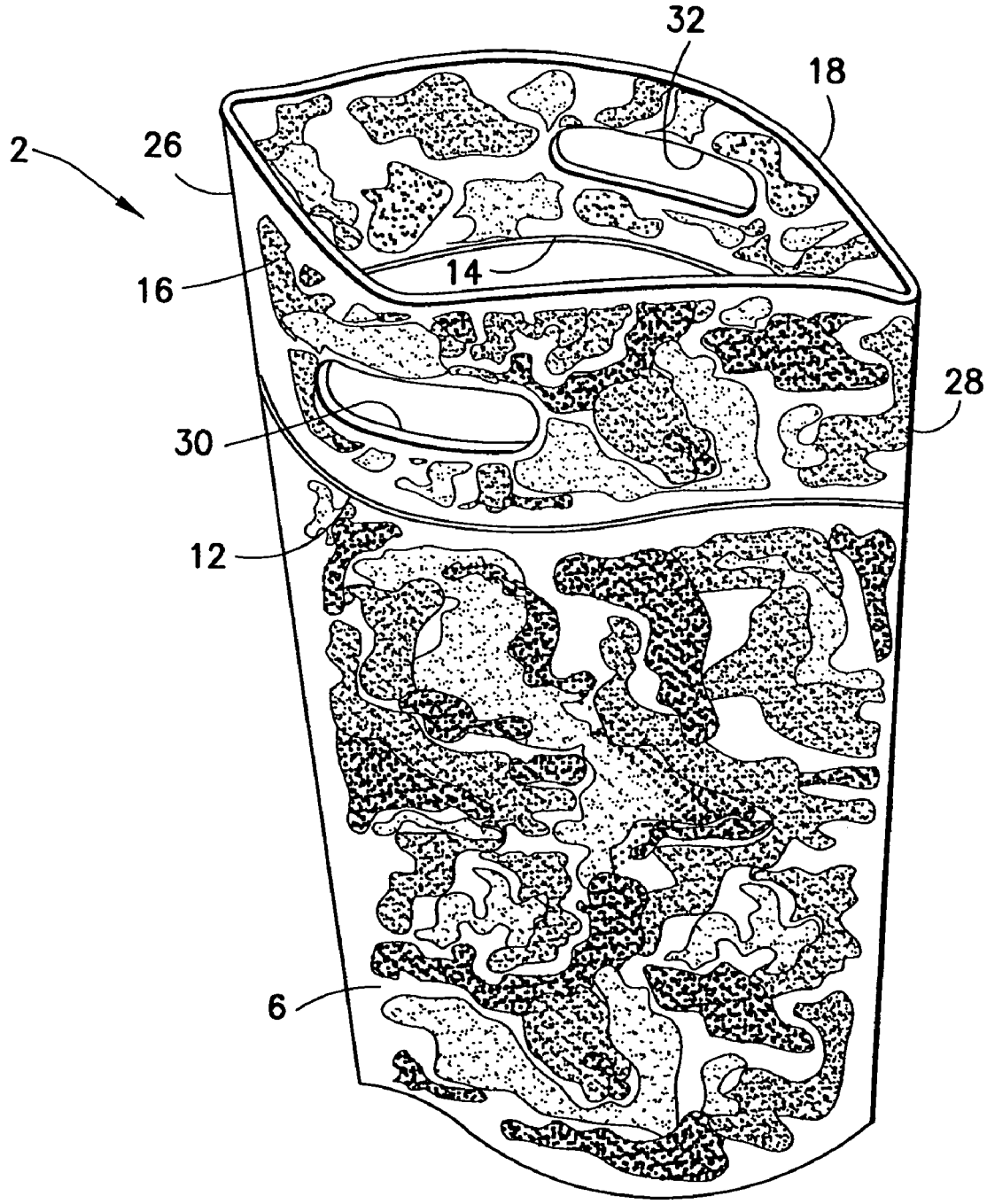
FIG. 1 is a drawing showing a camouflaged reclosable storage bag having an extruded plastic zipper in accordance with one embodiment of the invention.
Figure 2:
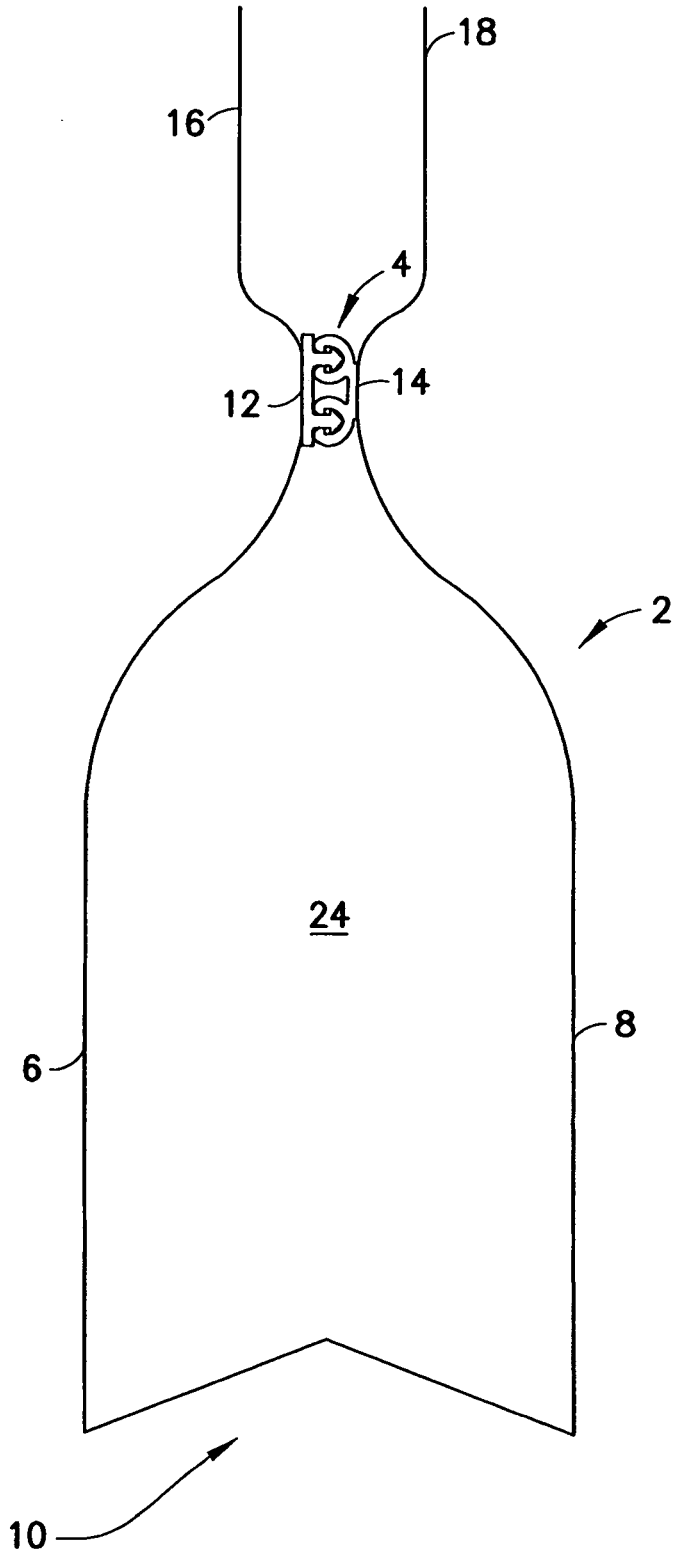
FIG. 2 is a drawing showing a sectional view of the storage bag depicted in FIG. 1.

A camouflaged reclosable storage bag 2 is shown in FIG. 1 with its mouth open. The bag is made from a web of laminated film material that has been folded, sealed and cut to form an individual bag. In general, the bag 2 comprises front and rear walls that have their side edges sealed together to form respective side seals 26 and 28. The bottom of the bag has a gusset, which is not visible in FIG. 1, but is designated by numeral 10 in FIG. 2. One extruded flangeless zipper strip 12 having a substantially constant profile along its length is joined to the interior surface of the front wall of the bag, while another extruded flangeless zipper strip 14 having a substantially constant profile along its length is joined to the interior surface of the front wall of the bag. The flangeless zipper strips 12 and 14 extend from one side of the bag to the other side, with the terminal portions of the zipper strips at one end being sealed together and captured in the side seal 26 of the bag, while the terminal portions of the zipper strips at the other end are sealed together and captured in the side seal 28 of the bag. As best seen in FIG. 2, the zipper strips 12, 14 form a so-called "string" zipper 4 at an elevation in the bag that, for purposes of this disclosure, will be deemed the "mouth" of the bag. That mouth is closed by the string zipper 4 when the closure profiles of the zipper strips are interlocked with each other along their entire lengths, and is open when the closure profiles of the zipper strips are disengaged.

The portions of the bag at and below the elevation of the string zipper 4 form a receptacle in which articles of clothing or other items can be stored. As best seen in FIG. 2, these portions include a receptacle front wall 6, a receptacle rear wall 8 and the panels of the bottom gusset 10, which together form the boundaries of an interior volume 24 of the receptacle. The bottom gusset 10 is formed by folding the laminated film material during the manufacturing process. In FIG. 2, the mouth of the bag is shown closed by interlocking of respective mating closure profiles of the zipper strips 12 and 14, described in more detail below. The receptacle walls 6 and 8 are respectively sealed to the backs of the bases of the interlockable zipper strips 12 and 14 by respective permanent or hard seals, formed by conduction heat sealing along respective lines or bands of joinder, respectively. Alternatively, the interlockable zipper strips can be attached to the walls by adhesive, application of ultrasonic energy, or other suitable bonding or sealing means.

The walls of the bag 2 extend beyond the zipper seals 12 and 14, these upper portions of the walls being respectively designated by numerals 16 and 18 and will be referred to herein as the "header walls". In the disclosed embodiment, the receptacle walls 6, 8 and the header walls 16, 18 are all portions of the same web of laminated film material. However, it should be appreciated that the header walls could be formed separately from and then joined to the receptacle walls in the area of the zipper seals 12, 14, and joined to each other to form side seals 26, 28.

Figure 3:
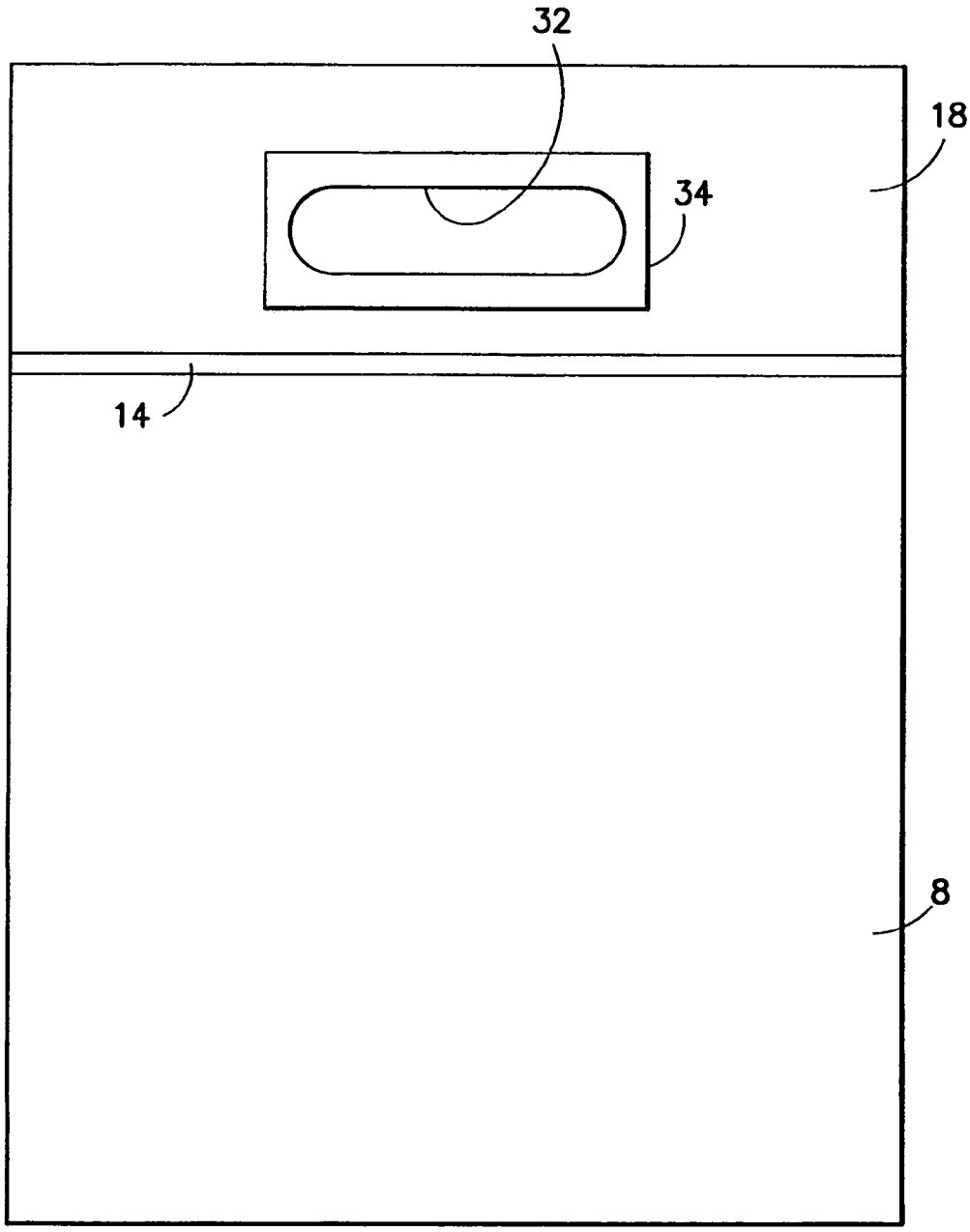
FIG. 3 is a drawing showing a rear view of one wall of the storage bag depicted in FIG. 1. The side of the wall visible in FIG. 3 is the side that faces the interior of the bag.

As seen in FIG. 1, each header wall 16, 18 has a respective opening 30, 32. When the header walls 16 and 18 are brought together, the openings 30 and 32 overlap each other or are aligned. In this state, the portions of the header walls immediately above the openings 30 and 32 serve the function of a handle, with the openings allowing a person to pass his fingers through for grasping the handle. To prevent the material above openings 30 and 32 from being stretched by the weight of the contents of the storage bag, the laminated wall material of the entire bag may be made of sufficiently strong and thick material, or only the header wall material along the periphery of the openings 30 and 32 can be reinforced. In accordance with the latter embodiment, partly depicted in FIG. 3, a reinforcement patch 34 can be seen attached or laminated to the header wall 18 along the periphery of the opening 32. A similar reinforcement patch would be attached or laminated to the opposing header wall. In accordance with one method manufacture, a pair of rectangular patches could be sealed to each bag-width section of the continuous web of laminated film material at respective mirror-image positions on opposing sides of a centerline of the web. Each opening 30 and 32 would then be formed by cutting or punching through both the web and the respective reinforcement patch.

As seen in FIG. 1, the laminated film material of the bag has a camouflage pattern printed thereon. In accordance with one embodiment of the invention, the laminated film material comprises a first layer of thermoplastic film material having a surface suitable for printing thereon, a camouflage pattern printed on that print-receptive surface, and a second layer of clear thermoplastic film material that is laminated to the printed side of the first layer, thereby trapping any emanations or odors from the printing in between the two thermoplastic layers. The first layer will form the inner layer of the bag, while the second layer forms the outer layer of the bag. This entrapment between layers of emanations from the printed matter protects the printed matter from being damaged or degraded by frictional contact with or scraping against external objects or the articles stored inside the bag, exposure to the elements of the weather, or other factors. In one non-limitative example, the print-receptive layer is made of low-density polyethylene (LDPE), while the covering layer is made of gas-impermeable thermoplastic material, such as nylon, polyester, polyvinyl dichloride, or ethylene vinyl alcohol.

The embodiments having printed camouflage are not limited to any particular camouflage pattern. Depending on the intended field of use, a camouflage pattern may be selected that mimics the visual presentation of a particular outdoor environment.

In accordance with a further aspect, the bag 2 shown in FIGS. 1 and 2 may also have the capability to prevent the diffusion of odors through the bag material. In accordance with one embodiment, this is accomplished by providing a laminated film material wherein the inner layer has odor-adsorbing or odor-absorbing properties, while the outer layer is made of a gas-impermeable thermoplastic material, such as nylon, polyester, polyvinyl dichloride, or ethylene vinyl alcohol, that acts as a barrier to gas passing through the bag walls.

More specifically, the inner layer is formed by blending an odor-eliminating chemical agent into the extrusion melt and then extruding a layer of film. Resin pellets containing a selected odor-eliminating chemical agent are commercially available and can be mixed with resin pellets not containing that chemical agent when the pellets are melted and mixed to form a homogeneously blend. The composition or formulation of the chemical agent will depend on the particular odor or odors sought to be eliminated. For example, the chemical agent may be a desiccant that absorbs atmospheric moisture, which contains odor molecules. One suitable resin for the inner layer is LDPE, which forms a breathable substrate. The additive will tend to exude to the surface of the polyethylene layer, so that the majority of the odor-eliminating chemical agent will reside on the surface of the polyethylene, where it is most effective. The outer barrier layer prevents contamination of the inner layer from outside the bag. For example, in the case of a chemical agent that adsorbs odorous substances, the odorous substances attach to bonding sites until the bonding sites are filled, at which point the odor-eliminating agent loses effectiveness. The gas barrier layer allows the inner layer to absorb or adsorb odors from the contents of the bag without absorbing or adsorbing odors from outside the bag, which might diminish its effectiveness.

In accordance with a further variation, the inner layer may further comprise a chemical agent that inhibits oxidation of metal inside the bag. One suitable corrosion-inhibiting chemical agent is triazole. This feature has useful application in a hunter's gun bag, with or without camouflage.

The string zipper depicted in FIG. 2 is commercially available from Minigrip/Zip-Pak, a division of Illinois Tool Works Inc. having offices in Glenview Ill. One zipper strip 12 has a profiled structure comprising two male members, while the other zipper strip 14 has a profiled structure comprising two female members which respectively mate with the male members during zipper closure. Each male member has a generally arrow-shaped rib-like male profile; each female member has a complementary, generally C-shaped female profile. Each zipper strip further comprises a respective base portion having substantially no flanges. Preferably, each base portion is a resiliently flexible self-supporting structure having a thickness greater than the thickness of the receptacle walls of the bag in which the zipper will be installed. FIG. 2 shows one male member engaged in one female member and the other male member engaged in the other female member.

In the particular zipper embodiment shown in FIG. 2, the profile of each male member has a stem with a generally triangular head at the tip of the stem, the tip being the portion of the male member furthest away from the base of the profiled structure. The profile of each female member comprises a pair of hooks that grip the head of the male member and latch under it. These hooks extend from a base or root of the female member. The detents at the ends of the hooks are inclined and generally directed toward each other, the detents of the hooks defining a mouth that communicates with a groove defined by the walls of the hooks and root of the female member. The groove of each female member receives the head of the corresponding male member when the zipper is closed, as shown in FIG. 2.

To open the closed zipper, the two sides of the zipper are pulled apart with sufficient force to pull the heads of the male members out of the female members. When the sides of the heads of the male members clear the detents of the hooks of the female member, the male and female members are no longer interlocked and the zipper is open.

The present invention does not require a zipper of the type shown in FIG. 2. Other types of zippers can be employed. For example, instead of interlocking rib and groove closure elements having so-called male and female profiles, interlocking alternating hook-shaped closure elements can be used. In other words, hooks of the type shown in FIG. 2 as part of zipper strip 14 can be incorporated on both zipper strips.

Figure 4:
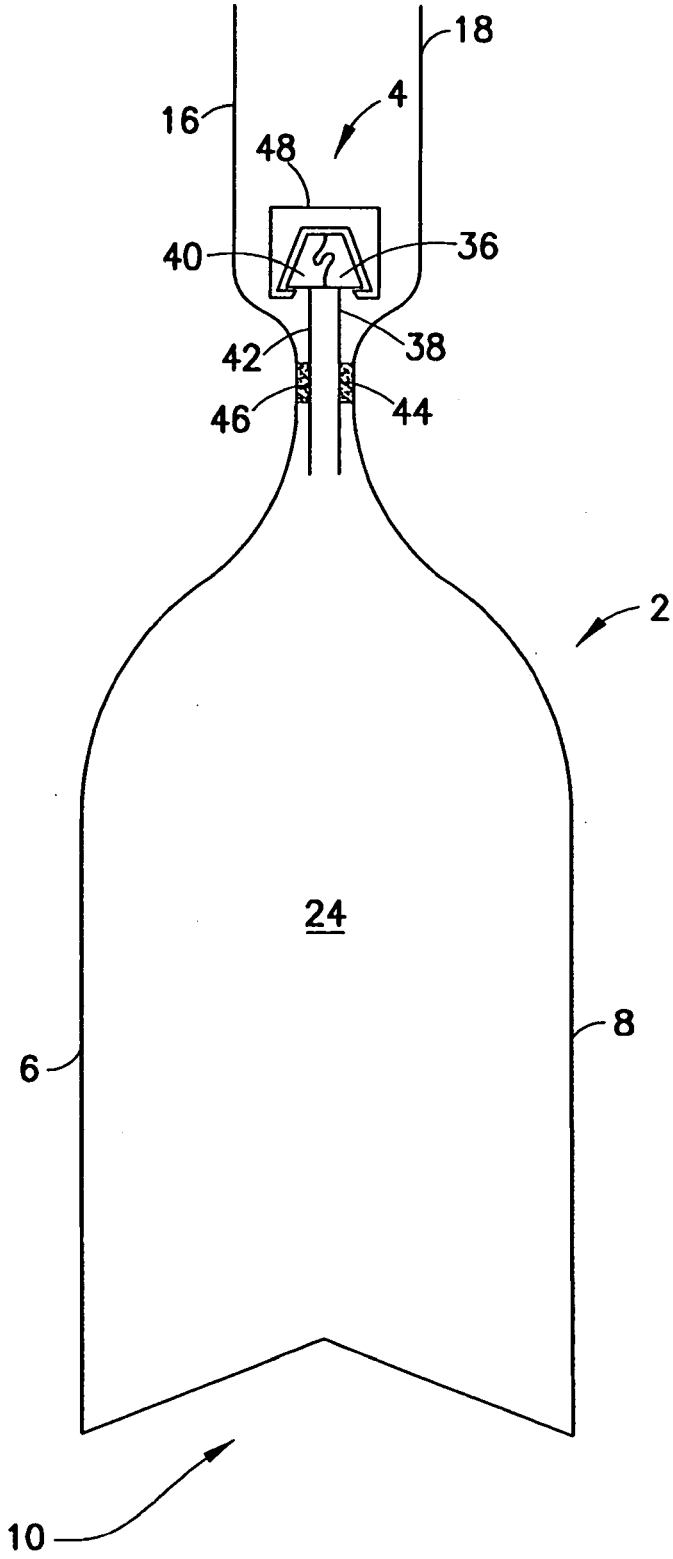
FIG. 4 is a drawing showing a sectional view of a reclosable storage bag having a slider-operated extruded plastic zipper in accordance with another embodiment of the invention.

Furthermore, zippers comprising flanged zipper strips can be employed in place of string zippers, as will now be described with reference to FIG. 4. In this embodiment, a slider-zipper assembly 20 is installed in the mouth of the receptacle formed by walls 6 and 8 and bottom gusset 10. The assembly 20 comprises an extruded plastic zipper and a molded plastic slider 48 mounted thereto. The zipper comprises first and second flanged zipper parts. The first flanged zipper part comprises a first profiled closure member 36 and a first flange 38, and the second flanged zipper part comprises a second profiled closure member 40 and a second flange 42. The profiled closure members 36 and 40 are mutually interlockable. Flange 38 has a band-shaped portion joined to an opposing portion of wall 8 by conduction heat sealing, while the flange 42 has a band-shaped portion joined to an opposing portion of wall 6 by conduction heat sealing, thereby forming respective so-called "permanent" seals 44 and 46.

The slider 48 is mounted to the zipper and is configured to close portions of the zipper as the slider is moved in one direction along the zipper and to open portions of the zipper as the slider is moved in the opposite direction along the zipper in the manner disclosed in detail in U.S. Pat. No. 6,047,450. More precisely, the slider 48 is designed to cam the lower portions of the closure profiles toward each other to the closure profiles to rotate in opposite directions about a fulcrum point of contact. This causes the upper portions of the closure profiles to move apart and disengage. In this example, slider 48 does not have a plow or separating finger. However, slider-zipper assemblies of the type wherein the slider has a separating finger for separating the zipper halves during slider travel can be used in the reclosable camouflaged and/or scent-free bags, packs or sacks of the type disclosed herein.

In accordance with some embodiments of the invention, the bag, pack or sack incorporates both camouflage and odor elimination and/or corrosion inhibition means. In accordance with other embodiments, the bag, pack or sack incorporates camouflage, but not odor elimination or corrosion inhibition means. In accordance with further embodiments, the bag, pack or sack incorporates odor elimination means or corrosion inhibition means, but not camouflage. The method of manufacturing the first category of embodiments will now be described in detail, but it should be understood that the method steps for including an odor-eliminating chemical agent in the extrusion melt can be eliminated if a camouflaged bag without odor elimination is called for, whereas the method steps for including camouflage can be eliminated if a bag without camouflage is called for.

In accordance with one embodiment of the method of manufacture, pellets of resin containing a concentrate comprising an odor-eliminating chemical agent and/or a corrosion-inhibiting chemical agent are added to pellets of resin that do not contain that chemical agent. A suitable resin is LDPE. However, the invention is not limited to the use of polyethylene. Other thermoplastic materials can be used. These pellets are then melted and mixed to homogeneously blend the chemical agent throughout the molten resin. The molten resin is then pressed through a die orifice to extrude a continuous sheet of thermoplastic film that will be wound on a roll after cooling.

Alternatively, the odor-eliminating and/or corrosion-inhibiting chemical agent could be sprayed onto one or both surfaces of a web of thermoplastic film before lamination to another web.

In the next stage of manufacture, the polyethylene film with odor-eliminating chemical agent blended therein is unwound from the roll and fed to a printer that prints a camouflage pattern onto the surface on one side of the polyethylene film. When the print has dried, the polyethylene film can be rewound and transported to a laminator at a different site or can be fed directly to a laminator at the same site. The laminator continuously laminates the continuous web of printed film to another continuous web of thermoplastic film, preferably made of a gas-impermeable thermoplastic material. The two continuous webs are fed to the laminator in overlapping relationship, with the printed side of the first web in contact with the second web. The two webs can be laminated together, for example, by passing them through a pair of heated press rolls. The end result is a continuous web of laminated material, with the printed camouflage pattern trapped between the two layers at their interface.

The laminated web is then fed to a conventional bag making machine (or wound on a roll and transported to a bag making machine). An automated system (not shown) is used to apply a continuous length of zipper tape to the laminated web. The laminated web is advanced by pinch rollers that pull the web through the machine. Zipper sealing can be performed continuously using a drag sealer or intermittently using reciprocating sealing bars. If a slider is to be inserted at spaced intervals along the zipper tape, then zipper sealing to the laminated web should be performed intermittently to accommodate intermittent ultrasonic welding to form slider end stops on the zipper tape followed by intermittent slider insertion, both steps occurring upstream of the zipper sealing station.

One method for forming the laminated web into a reclosable bag having a string zipper and no slider will now be described. The laminated web is pulled over a V-shaped folding board or plow 40, which folds the laminated web into a V shape with the odor-eliminating layer on the inside of the V. The zipper tape is paid out from a spool and pulled through a zipper guide that guides the zipper into a position inside the folded laminated web and oriented generally parallel to the fold in the web and at a predetermined elevation above the fold and a predetermined depth below the edges of the laminated web. In this example, it will be assumed that the zipper tape and the laminated web are moved intermittently with most operations being performed during dwell times.

At the sealing stations, a pair of opposing reciprocating horizontal heated sealing bars are extended at the elevation of the string zipper. The sealing bars apply sufficient heat and pressure to cause the portions of the laminated web in contact with the backs of the respective zipper strips of the string zipper to be sealed thereto. This section of the laminated web with attached string zipper section is then advanced to a cross sealing station, where the zipper/web assembly is cross sealed by a pair of opposing reciprocating vertical heated sealing bars, which are extended to form a cross seal that extends from the fold in the laminated web to the edges of the laminated web, which are disposed above the string zipper. After each cross sealing operation, the zipper/web assembly is advanced one bag width and the process is repeated. At the next station, openings are punch or cut in those portions of the laminated web that are disposed above the elevation of the string zipper. These are the openings 30 and 32 shown in FIG. 1. This section of the zipper/web assembly is then advanced to the cutting station, where the zipper/web assembly is cut along a vertical line that generally bisects the cross seal, thereby severing an individual bag from the zipper/tape assembly.

If the openings in the top of the bag require reinforcement, the reinforcement patches can be attached to the laminated web before the latter is folded. It should also be appreciated that instead of folding the laminated web and then attaching both sides of the string zipper to the folded web, it is possible to first seal one of the interlocked zipper strips of the string zipper to the unfolded web, then fold the web over and seal the other zipper strip to the web. Alternatively, the zipper strips of the string zipper could be unwound from separate spools and sealed to the unfolded web separately, but in parallel with each other. After the zipper strips are sealed to the web, the web would be folded so that the zipper strips are aligned and then the aligned zipper strips would be pressed together by press rolls, causing the string zipper to close.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "bag" includes bags, pouches, sacks, packs, and the like. As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two zipper strips that have mutually interlockable closure profiles and substantially no flange portions.

The invention claimed is:

1. A bag comprising a receptacle having a mouth at an upper end, and a plastic zipper attached to said mouth, wherein said zipper comprises first and second zipper strips that extend across said mouth, said first zipper strip comprising a first closure profile and said second zipper strip comprising a second closure profile, said first and second closure profiles being mutually interlockable, said mouth being closed when said first and second closure profiles are interlocked and being open when said first and second closure profiles are disengaged, and wherein said receptacle is made of laminated material, said laminated material comprising a web of gas-permeable thermoplastic material, a web of gas-impermeable thermoplastic material, and an odor-eliminating chemical agent supported by said web of gas-permeable thermoplastic material, wherein said web of gas-impermeable thermoplastic material is external to said web of gas-permeable thermoplastic material, and an inner surface of said web of gas-permeable thermoplastic material is exposed to an interior volume of said receptacle, wherein opposing surfaces of said web of gas-permeable thermoplastic material and said web of gas-impermeable thermoplastic material form an interface, at least one of said opposing surfaces having a camouflage pattern printed thereon.

2. The bag as recited in claim 1, wherein said web of gas-permeable thermoplastic material further comprises a corrosion-inhibiting chemical agent.

3. The bag as recited in claim 1, wherein said first zipper strip comprises a first flange joined to said receptacle, and said second zipper strip comprises a second flange joined to said receptacle.

4. The bag as recited in claim 1, wherein said zipper is a string zipper, each of said first and second zipper strips comprising a respective base joined to said receptacle.

5. The bag as recited in claim 1, wherein said receptacle comprises first and second walls joined together along first and second side seals, further comprising first and second header walls projecting upward from said receptacle and joined together along said first and second side seals, said first header wall having a first opening, and said second header wall having a second opening, said first and second openings being generally mutually overlapping when said mouth of said receptacle is closed.

6. The bag as recited in claim 5, wherein said first header wall is integrally connected to said first wall of said receptacle, and said second header wall is integrally connected to said second wall of said receptacle.

7. The bag as recited in claim 1, wherein said receptacle comprises first and second walls joined together along first and second side seals, and a gusseted bottom connected to said first and second walls.

8. The bag as recited in claim 1, wherein the majority of said odor-eliminating agent is disposed on said inner surface of said web of gas-permeable thermoplastic material.

9. A bag comprising a receptacle having a mouth at an upper end, and a plastic zipper attached to said mouth, wherein said zipper comprises first and second zipper strips that extend across said mouth, said first zipper strip comprising a first closure profile and said second zipper strip comprising a second closure profile, said first and second closure profiles being mutually interlockable, said mouth being closed when said first and second closure profiles are interlocked and being open when said first and second closure profiles are disengaged, and wherein said receptacle is made of laminated material, said laminated material comprising a first layer comprising a web of gas-permeable thermoplastic material, a second layer comprising a web of gas-impermeable thermoplastic material, and printed matter having a camouflage pattern, said first and second layers being fused together with said printed matter sandwiched and sealed therebetween, wherein said second layer is external to said first layer.

10. The bag as recited in claim 9, wherein said first layer further comprises a corrosion-inhibiting chemical agent.

11. The bag as recited in claim 9, wherein said first zipper strip comprises a first flange joined to said receptacle, and said second zipper strip comprises a second flange joined to said receptacle.

12. The bag as recited in claim 9, wherein said zipper is a string zipper, each of said first and second zipper strips comprising a respective base joined to said receptacle.

13. The bag as recited in claim 9, wherein said receptacle comprises first and second walls joined together along first and second side seals, further comprising first and second header walls projecting upward from said receptacle and joined together along said first and second side seals, said first header wall having a first opening, and said second header wall having a second opening, said first and second openings being generally mutually overlapping when said mouth of said receptacle is closed.

14. The bag as recited in claim 13, wherein said first header wall is integrally connected to said first wall of said receptacle, and said second header wall is integrally connected to said second wall of said receptacle.

15. The bag as recited in claim 9 wherein said receptacle comprises first and second walls joined together along first and second side seals, and a gusseted bottom connected to said first and second walls.

16. The bag as recited in claim 9, further comprising an odor-eliminating chemical agent supported by said web of gas-permeable thermoplastic material.

* * * * *